US008718506B2

(12) United States Patent
Samei et al.

(10) Patent No.: US 8,718,506 B2
(45) Date of Patent: May 6, 2014

(54) FIXING DEVICE AND IMAGE FORMING APPARATUS INCORPORATING SAME

(75) Inventors: Masahiro Samei, Kanagawa (JP); Yasunori Ishigaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 356 days.

(21) Appl. No.: 13/298,790

(22) Filed: Nov. 17, 2011

(65) Prior Publication Data

US 2012/0148287 A1 Jun. 14, 2012

(30) Foreign Application Priority Data

Dec. 9, 2010 (JP) ..... 2010-274236

(51) Int. Cl.
*G03G 15/00* (2006.01)

(52) U.S. Cl.
USPC ..... 399/90; 399/67; 399/69

(58) Field of Classification Search
USPC ..... 399/38, 67, 69, 70, 75, 90, 320, 328, 399/329; 219/216, 619
See application file for complete search history.

(56) References Cited

U.S. PATENT DOCUMENTS

| | | | | |
|---|---|---|---|---|
| 7,483,666 | B2 * | 1/2009 | Tatematsu et al. | 399/329 |
| 7,912,392 | B2 | 3/2011 | Yoshinaga et al. | |
| 8,175,480 | B2 * | 5/2012 | Seo et al. | 399/67 |
| 8,385,801 | B2 * | 2/2013 | Sugaya | 399/329 |
| 8,472,827 | B2 * | 6/2013 | Hase | 399/69 |
| 2009/0169232 | A1 | 7/2009 | Kunii et al. | |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2011/0064437 | A1 | 3/2011 | Yamashina et al. | |
| 2011/0091226 | A1 | 4/2011 | Ishigaya et al. | |
| 2011/0182634 | A1 | 7/2011 | Ishigaya et al. | |
| 2011/0217057 | A1 | 9/2011 | Yoshinaga et al. | |
| 2011/0274473 | A1 | 11/2011 | Shinshi et al. | |

FOREIGN PATENT DOCUMENTS

| | | |
|---|---|---|
| JP | 2000-30850 | 1/2000 |
| JP | 2001-125407 | 5/2001 |
| JP | 2006-71960 | 3/2006 |
| JP | 2009-282413 | 12/2009 |

OTHER PUBLICATIONS

U.S. Appl. No. 13/109,346, filed May 17, 2011, Yasunori Ishigaya, et al.
U.S. Appl. No. 13/252,543, filed Oct. 4, 2011, Yasunori Ishigaya, et al.
U.S. Appl. No. 13/272,629, filed Oct. 13, 2011, Takumi Waida, et al.
U.S. Appl. No. 13/300,013, filed Nov. 18, 2011, Samei, et al.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A fixing device includes a first alternating electric current power supply that outputs a first alternating electric current having a first frequency that causes a magnetic flux generated by an exciting coil to reach a first heat generation layer of a fixing rotary body; a second alternating electric current power supply that outputs a second alternating electric current having a second frequency that is lower than the first frequency and causes the magnetic flux to reach the first heat generation layer of the fixing rotary body and a second heat generation layer of a heat generator; and a switch circuit connected to the exciting coil, the first alternating electric current power supply, and the second alternating electric current power supply to selectively connect the first alternating electric current power supply or the second alternating electric current power supply to the exciting coil.

20 Claims, 7 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-274236, filed on Dec. 9, 2010, in the Japanese Patent Office, the entire disclosure of which is hereby incorporated by reference herein.

FIELD OF THE INVENTION

Exemplary aspects of the present invention relate to a fixing device and an image forming apparatus, and more particularly, to a fixing device for fixing a toner image on a recording medium, and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing belt, formed into a loop, to apply heat to the recording medium bearing the toner image, and a pressing roller, disposed opposite the fixing belt, to apply pressure to the recording medium. A stationary, nip formation pad disposed inside the loop formed by the fixing belt is pressed against the pressing roller disposed outside the loop formed by the fixing belt via the fixing belt to form a fixing nip between the fixing belt and the pressing roller through which the recording medium bearing the toner image passes. As the fixing belt and the pressing roller rotate and convey the recording medium through the fixing nip, they apply heat and pressure to the recording medium to fix the toner image on the recording medium.

As a mechanism that heats the fixing belt, the fixing device may include an exciting coil disposed opposite the fixing belt, which generates a magnetic flux toward the fixing belt, thus heating a heat generation layer of the fixing belt by electromagnetic induction.

For example, Japanese publication No. P2009-282413A proposes a configuration in which a temperature-sensitive magnetic member, which generates heat by a magnetic flux generated by the exciting coil, separably contacts the inner circumferential surface of the fixing belt. Before the fixing belt is heated to a desired fixing temperature, the temperature-sensitive magnetic member is isolated from the fixing belt; therefore it does not draw heat from the fixing belt, shortening a warm-up time of the fixing belt. Conversely, after the fixing belt has been heated to the desired fixing temperature, the temperature-sensitive magnetic member contacts the fixing belt to conduct heat thereto supplementarily, thus maintaining the fixing temperature of the fixing belt.

However, such configuration has a drawback in that, even when the temperature-sensitive magnetic member is isolated from the fixing belt during warm-up, it is still heated by the magnetic flux generated by the exciting coil. That is, the magnetic flux is not concentrated solely on the fixing belt, thereby degrading heating efficiency for heating the fixing belt.

As another example, Japanese patent No. P3,527,442 proposes a configuration in which a conductive member is rotatably disposed inside a heating roller in such a manner that it is moved between the two positions: a first position where it is disposed opposite an exciting coil disposed outside the heating roller, and a second position where it is not disposed opposite the exciting coil. With this configuration, before the heating roller is heated to a desired fixing temperature, the conductive member is at the second position where it is not disposed opposite the exciting coil so that a magnetic flux generated by the exciting coil is concentrated solely on the heating roller, not reaching the conductive member. By contrast, after the heating roller has been heated to the desired fixing temperature, the conductive member is moved to the first position where it is disposed opposite the exciting coil.

However, such configuration also has a drawback in that the heating roller is constructed of a heat generation layer heated by the magnetic flux generated by the exciting coil and a temperature-sensitive magnetic layer, which prevents overheating of the heating roller, combined with the heat generation layer. Since the temperature-sensitive magnetic layer is combined with the heat generation layer, it draws heat from the heat generation layer, lengthening a warm-up time of the heating roller.

SUMMARY OF THE INVENTION

This specification describes below an improved fixing device. In one exemplary embodiment of the present invention, the fixing device includes a fixing rotary body, a pressing rotary body, a heat generator, an exciting coil, a first alternating electric current power supply, a second alternating electric current power supply, and a switch circuit. The fixing rotary body includes a first heat generation layer. The pressing rotary body is disposed parallel to and pressed against the fixing rotary body to form a fixing nip therebetween through which a recording medium bearing a toner image is conveyed. The heat generator, which heats the fixing rotary body, is disposed opposite the fixing rotary body and includes a second heat generation layer. The exciting coil, which generates a magnetic flux, is disposed opposite the heat generator via the fixing rotary body. The first alternating electric current power supply is connectable to the exciting coil to output a first alternating electric current having a first frequency that causes the magnetic flux generated by the exciting coil to reach the first heat generation layer of the fixing rotary body. The second alternating electric current power supply is connectable to the exciting coil to output a second alternating electric current having a second frequency that is lower than the first frequency and causes the magnetic flux generated by the exciting coil to reach the first heat generation layer of the fixing rotary body and the second heat generation layer of the heat generator. The switch circuit is connected to the exciting coil, the first alternating electric current power supply, and the second alternating electric current power supply to selectively connect the first alternating electric current power supply or the second alternating electric current power supply to the exciting coil.

This specification further describes below an improved fixing device. In one exemplary embodiment of the present invention, the fixing device includes a fixing rotary body, a pressing rotary body, a heat generator, a first exciting coil, a second exciting coil, an alternating electric current power supply, and a switch circuit. The fixing rotary body includes a first heat generation layer. The pressing rotary body is disposed parallel to and pressed against the fixing rotary body to form a fixing nip therebetween through which a recording medium bearing a toner image is conveyed. The heat generator, which heats the fixing rotary body, is disposed opposite the fixing rotary body and includes a second heat generation layer. The first exciting coil having a first inductance is disposed opposite the heat generator via the fixing rotary body to generate a magnetic flux. The second exciting coil having a second inductance greater than the first inductance is disposed opposite the heat generator via the fixing rotary body to generate a magnetic flux. The alternating electric current power supply is connectable to the first exciting coil to output a first alternating electric current having a first frequency that causes the magnetic flux generated by the first exciting coil to reach the first heat generation layer of the fixing rotary body and connectable to the second exciting coil to output a second alternating electric current having a second frequency that is lower than the first frequency and causes the magnetic flux generated by the second exciting coil to reach the first heat generation layer of the fixing rotary body and the second heat generation layer of the heat generator. The switch circuit is connected to the first exciting coil, the second exciting coil, and the alternating electric current power supply to selectively connect the alternating electric current power supply to the first exciting coil or the second exciting coil.

This specification further describes below an improved fixing device. In one exemplary embodiment of the present invention, the fixing device includes a fixing rotary body, a pressing rotary body, an exciting coil, a first alternating electric current power supply, a second alternating electric current power supply, and a switch circuit. The fixing rotary body includes a first heat generation layer. The pressing rotary body including a second heat generation layer is disposed parallel to and pressed against the fixing rotary body to form a fixing nip therebetween through which a recording medium bearing a toner image is conveyed. The exciting coil, which generates a magnetic flux, is disposed opposite the pressing rotary body via the fixing rotary body. The first alternating electric current power supply is connectable to the exciting coil to output a first alternating electric current having a first frequency that causes the magnetic flux generated by the exciting coil to reach the first heat generation layer of the fixing rotary body. The second alternating electric current power supply is connectable to the exciting coil to output a second alternating electric current having a second frequency that is lower than the first frequency and causes the magnetic flux generated by the exciting coil to reach the first heat generation layer of the fixing rotary body and the second heat generation layer of the pressing rotary body. The switch circuit is connected to the exciting coil, the first alternating electric current power supply, and the second alternating electric current power supply to selectively connect the first alternating electric current power supply or the second alternating electric current power supply to the exciting coil.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
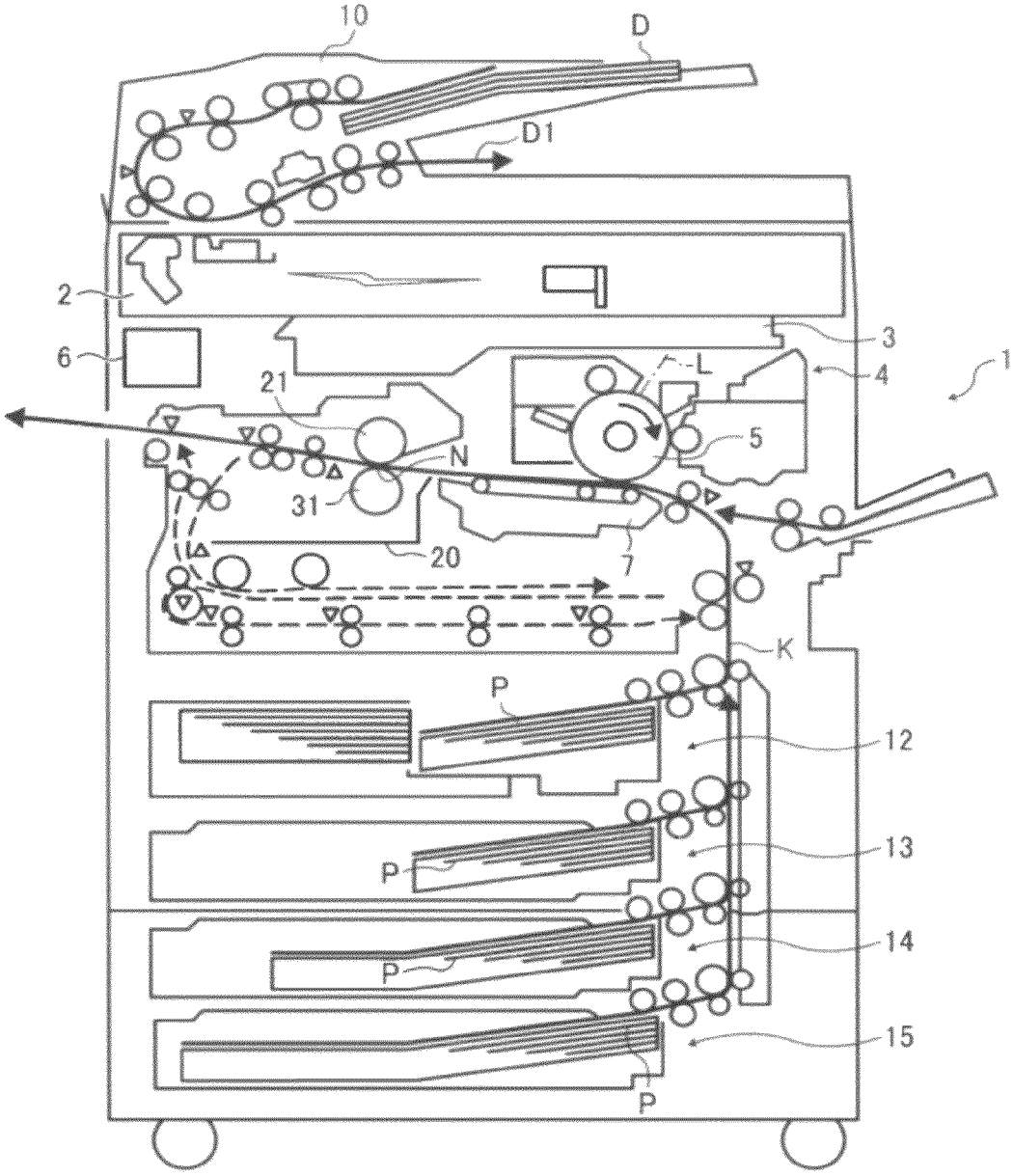
FIG. 1 is a schematic sectional view of an image forming apparatus according to a first exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

Referring to FIGS. 1 to 5, the following describes a first illustrative embodiment of the present invention.

Referring to FIG. 1, a description is now given of the structure of the image forming apparatus 1. FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a copier for forming a toner image on a recording medium.

As illustrated in FIG. 1, the image forming apparatus 1 includes an auto document feeder 10, disposed atop the image forming apparatus 1, which feeds an original document D bearing an original image placed thereon to an original document reader 2 disposed below the auto document feeder 10. The original document reader 2 optically reads the original image on the original document D to generate image data and sends it to an exposure device 3 disposed below the original document reader 2. The exposure device 3 emits light L onto a photoconductive drum 5 of an image forming device 4 disposed below the exposure device 3 according to the image data sent from the original document reader 2 to form an electrostatic latent image on the photoconductive drum 5. Thereafter, the image forming device 4 renders the electrostatic latent image formed on the photoconductive drum 5 visible as a toner image with developer (e.g., toner).

Below the image forming device 4 is a transfer device 7 that transfers the toner image formed on the photoconductive drum 5 onto a recording medium P sent from one of paper trays 12, 13, 14, and 15, each of which loads a plurality of recording media P (e.g., transfer sheets), disposed in a lower portion of the image forming apparatus 1 below the transfer device 7. The recording medium P bearing the transferred toner image is sent to a fixing device 20 disposed downstream from the transfer device 7 in a conveyance direction of the recording medium P, where a fixing belt 21 and a pressing roller 31 disposed opposite each other apply heat and pressure to the recording medium P, thus fixing the toner image on the recording medium P.

Referring to FIG. 1, a description is now given of the operation of the image forming apparatus 1 having the above-described structure.

An original document D bearing an original image, placed on an original document tray of the auto document feeder 10 by a user, is conveyed by a plurality of conveyance rollers of the auto document feeder 10 in a direction D1 above the original document reader 2. As the original document D passes over an exposure glass of the original document reader 2, the original document reader 2 optically reads the original image on the original document D to generate image data.

The image data are converted into an electric signal and then sent to the exposure device 3. The exposure device 3, serving as a writer, emits light L (e.g., a laser beam) onto the photoconductive drum 5 of the image forming device 4 according to the electric signal, thus writing an electrostatic latent image on the photoconductive drum 5.

The image forming device 4 performs a plurality of image forming processes as the photoconductive drum 5 rotates clockwise in FIG. 1: a charging process, an exposure process, and a development process. In the charging process, a charger of the image forming device 4 charges an outer circumferential surface of the photoconductive drum 5, accordingly the exposure device 3 emits light L onto the charged outer circumferential surface of the photoconductive drum 5 to form an electrostatic latent image thereon as described above in the exposure process. Thereafter, in the development process, a development device of the image forming device 4 develops the electrostatic latent image formed on the photoconductive drum 5 into a toner image with toner.

On the other hand, a recording medium P is sent to a transfer nip formed between the photoconductive drum 5 and the transfer device 7 from one of the plurality of paper trays 12 to 15, which is selected manually by the user using a control panel disposed atop the image forming apparatus 1 or automatically by an electric signal of a print request sent from a client computer. If the paper tray 12 is selected, for example, an uppermost recording medium P of a plurality of recording media P loaded in the paper tray 12 is conveyed to a registration roller pair disposed in a conveyance path K extending from each of the paper trays 12 to 15 to the transfer device 7.

When the uppermost recording medium P reaches the registration roller pair, it is stopped by the registration roller pair temporarily and then conveyed to the transfer nip formed between the photoconductive drum 5 and the transfer device 7 at a time when the toner image formed on the photoconductive drum 5 is transferred onto the uppermost recording medium P by the transfer device 7.

After the transfer of the toner image onto the recording medium P, the recording medium P bearing the toner image is sent to the fixing device 20 through a conveyance path extending from the transfer device 7 to the fixing device 20. As the recording medium P passes through a fixing nip N formed between the fixing belt 21 and the pressing roller 31 of the fixing device 20, it receives heat from the fixing belt 21 and pressure from the fixing belt 21 and the pressing roller 31, which fix the toner image on the recording medium P. Thereafter, the recording medium P bearing the fixed toner image is discharged from the fixing nip N to an outside of the image forming apparatus 1, thus completing a series of image forming processes.

Referring to FIGS. 2, 3A, 3B, 4A, and 4B, the following describes the structure and operation of the fixing device 20 installed in the image forming apparatus 1 described above.

Figure 2:
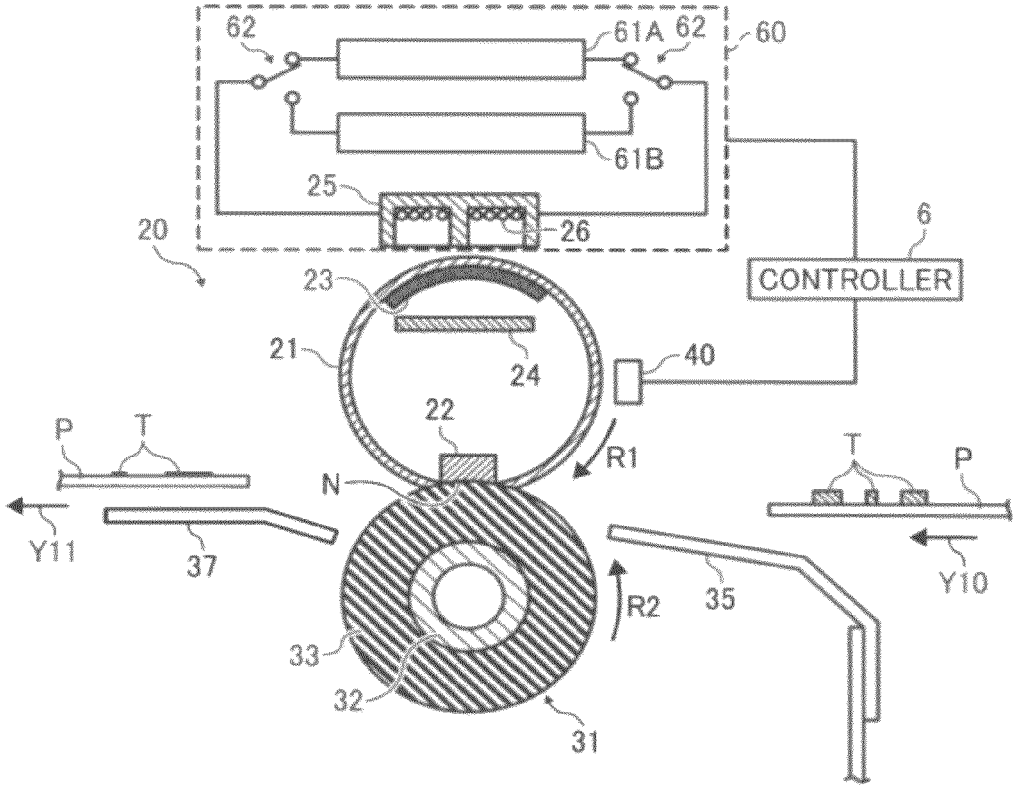
FIG. 2 is a vertical sectional view of a fixing device installed in the image forming apparatus shown in FIG. 1.
Figure 3A:
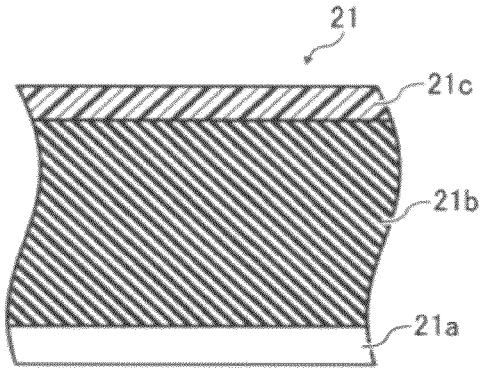
FIG. 3A is a partial vertical sectional view of a fixing belt installed in the fixing device shown in FIG. 2.
Figure 3B:
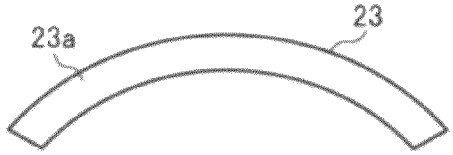
FIG. 3B is a vertical sectional view of a heat generator installed in the fixing device shown in FIG. 2.
Figure 4A:
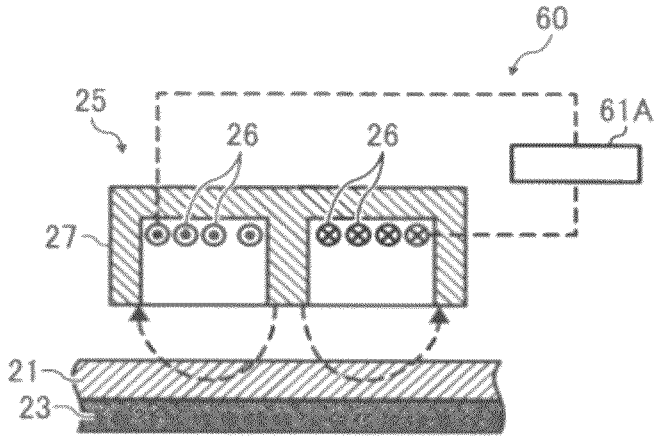
FIG. 4A is a partially enlarged vertical sectional view of the fixing belt shown in FIG. 3A, the heat generator shown in FIG. 3B, an exciting coil unit, and a first alternating electric current power supply installed in the fixing device shown in FIG. 2.
Figure 4B:
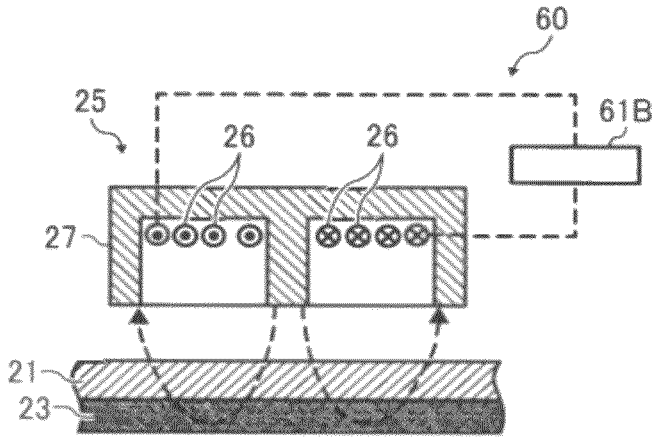
FIG. 4B is a partially enlarged vertical sectional view of the fixing belt shown in FIG. 3A, the heat generator shown in FIG. 3B, an exciting coil unit, and a second alternating electric current power supply installed in the fixing device shown in FIG. 2.

FIG. 2 is a vertical sectional view of the fixing device 20. FIG. 3A is a partial vertical sectional view of the fixing belt 21 of the fixing device 20. FIG. 3B is a vertical sectional view of a heat generator 23 of the fixing device 20. FIG. 4A is a partially enlarged vertical sectional view of the fixing belt 21, the heat generator 23, an exciting coil unit 25, and a first alternating electric current power supply 61A of the fixing device 20. FIG. 4B is a partially enlarged vertical sectional view of the fixing belt 21, the heat generator 23, the exciting coil unit 25, and a second alternating electric current power supply 61B.

As illustrated in FIG. 2, the fixing device 20 includes the fixing belt 21 formed into a loop; a nip formation pad 22, the heat generator 23, and a shield 24, which are disposed inside the loop formed by the fixing belt 21; and an exciting circuit 60, the pressing roller 31, a temperature sensor 40, and guides 35 and 37, which are disposed outside the loop formed by the fixing belt 21.

The fixing belt 21 is a flexible, thin endless belt serving as a fixing rotary body that rotates or moves clockwise in FIG. 2 in a rotation direction R1. As illustrated in FIG. 3A, the fixing belt 21, having a thickness not greater than about 1 mm, is constructed of multiple layers: a first heat generation layer 21*a* as a base layer; an elastic layer 21*b* disposed on the first heat generation layer 21*a*; and a release layer 21*c* disposed on the elastic layer 21*b*.

For example, the first heat generation layer 21*a* constitutes an inner circumferential surface of the fixing belt 21, that is, a contact face sliding over the nip formation pad 22 and the heat generator 23 disposed inside the loop formed by the fixing belt 21. The first heat generation layer 21*a*, made of a conductive material having a relatively low heat capacity, has a thickness in a range of from about several microns to about several hundred microns, preferably in a range of from about ten microns to about several tens of microns, thus serving as a heat generation layer heated by the exciting coil unit 25 by electromagnetic induction.

The elastic layer 21*b*, made of a rubber material such as silicone rubber, silicone rubber foam, and/or fluorocarbon rubber, has a thickness in a range of from about 100 μm to about 300 μm. The elastic layer 21*b* eliminates or reduces slight surface asperities of the fixing belt 21 at the fixing nip N formed between the fixing belt 21 and the pressing roller 31. Accordingly, heat is uniformly conducted from the fixing belt 21 to a toner image T on a recording medium P passing through the fixing nip N, minimizing formation of a rough image such as an orange peel image. According to the first illustrative embodiment, silicone rubber with a thickness of about 200 μm is used as the elastic layer 21*b*.

The release layer 21*c*, having a thickness in a range of from about 10 μm to about 50 μm, is made of tetrafluoroethylene-perfluoroalkylvinylether copolymer (PFA), polytetrafluoroethylene (PTFE), polyimide, polyetherimide, and/or polyether sulfide (PES). The release layer 21*c* releases or separates the toner image T from the fixing belt 21.

Inside the loop formed by the fixing belt 21 are fixedly disposed the nip formation pad 22, the heat generator 23, and the shield 24. Outside the loop formed by the fixing belt 21 is the exciting coil unit 25 serving as an induction heater disposed opposite the fixing belt 21 with a predetermined gap between the exciting coil unit 25 and a part of an outer circumferential surface of the fixing belt 21. The inner circumferential surface of the fixing belt 21 is applied with a lubricant that reduces friction between an outer circumferential surface of the nip formation pad 22 and the heat generator 23 and the inner circumferential surface of the fixing belt 21 sliding over the nip formation pad 22 and the heat generator 23.

The nip formation pad 22 contacting the inner circumferential surface of the fixing belt 21 is a stationary member fixedly disposed inside the loop formed by the fixing belt 21; thus, the rotating fixing belt 21 slides over the stationary, nip formation pad 22. Further, the nip formation pad 22 presses against the pressing roller 31 via the fixing belt 21 to form the fixing nip N between the fixing belt 21 and the pressing roller 31 through which the recording medium P bearing the toner image T passes. Lateral ends of the nip formation pad 22 in a longitudinal direction thereof parallel to an axial direction of the fixing belt 21 are mounted on and supported by side plates of the fixing device 20, respectively. The nip formation pad 22 is made of a rigid material that prevents substantial bending of the nip formation pad 22 by pressure applied from the pressing roller 31.

The nip formation pad 22 constitutes an opposed face (e.g., a contact face that contacts the inner circumferential surface of the fixing belt 21 sliding over the nip formation pad 22) facing the pressing roller 31 and having a concave shape corresponding to the curvature of the pressing roller 31. The recording medium P moves along the concave, opposed face of the nip formation pad 22 corresponding to the curvature of the pressing roller 31 and is discharged from the fixing nip N in a direction Y11. Thus, the concave shape of the nip formation pad 22 prevents the recording medium P bearing the fixed toner image T from adhering to the fixing belt 21, thereby facilitating separation of the recording medium P from the fixing belt 21.

As described above, according to the first illustrative embodiment, the nip formation pad 22 has a concave shape to form the concave fixing nip N. Alternatively, however, the nip formation pad 22 may have a flat, planar shape to form a planar fixing nip N. Specifically, the opposed face of the nip formation pad 22 disposed opposite the pressing roller 31 may have a flat, planar shape. Accordingly, the planar fixing nip N formed by the planar opposed face of the nip formation pad 22 is substantially parallel to an imaged side of the recording medium P. Consequently, the fixing belt 21 pressed by the planar opposed face of the nip formation pad 22 is precisely adhered to the recording medium P to improve fixing performance. Further, the increased curvature of the fixing belt 21 at an exit of the fixing nip N facilitates separation of the recording medium P discharged from the fixing nip N from the fixing belt 21.

As illustrated in FIG. 2, the heat generator 23, contacting the inner circumferential surface of the fixing belt 21, is disposed opposite the exciting coil unit 25 via the fixing belt 21. Lateral ends of the heat generator 23 in a longitudinal direction thereof parallel to the axial direction of the fixing belt 21 are mounted on and supported by the side plates of the fixing device 20, respectively.

As illustrated in FIG. 3B, the heat generator 23 is constructed of a single layer, a second heat generation layer 23*a* made of a conductive material. The second heat generation layer 23*a* is heated by the exciting coil unit 25 (depicted in FIG. 2) serving as an induction heater that heats the second heat generation layer 23*a* by electromagnetic induction. Specifically, the exciting coil unit 25 generates an alternating magnetic field that heats the second heat generation layer 23*a* of the heat generator 23 by electromagnetic induction, which in turn heats the fixing belt 21. In other words, the exciting coil unit 25 heats the heat generator 23 directly by electromagnetic induction and at the same time heats the fixing belt 21 indirectly via the heat generator 23.

As described above, since the fixing belt 21 has the first heat generation layer 21*a*, the alternating magnetic field generated by the exciting coil unit 25 also heats the first heat generation layer 21*a* by electromagnetic induction. In other words, the fixing belt 21 is heated by the exciting coil unit 25 directly by electromagnetic induction and at the same time is heated by the heat generator 23, which is heated by the exciting coil unit 25 by electromagnetic induction, indirectly, resulting in improved heating efficiency for heating the fixing belt 21. Thus, heat is conducted from the outer circumferential surface of the fixing belt 21 to the toner image T on the recording medium P passing through the fixing nip N formed between the fixing belt 21 and the pressing roller 31.

The temperature sensor 40 (e.g., a thermistor or a thermopile), disposed opposite the outer circumferential surface of the fixing belt 21, serves as a temperature detector that detects a temperature of the outer circumferential surface of the fixing belt 21. Based on the temperature detected by the temperature sensor 40, a controller 6, that is, a central processing unit (CPU) provided with a random-access memory (RAM) and a read-only memory (ROM), for example, controls output of the exciting coil unit 25, thus adjusting the temperature of the fixing belt 21 to a desired fixing temperature.

As illustrated in FIGS. 4A and 4B, the exciting coil unit 25 includes an exciting coil 26 and an exciting coil core 27. The exciting coil 26, extending in a longitudinal direction of the exciting coil unit 25 parallel to the axial direction of the fixing belt 21, is constructed of litz wire made of bundled thin wires wound around the exciting coil core 27 that covers a part of the outer circumferential surface of the fixing belt 21. As the first alternating electric current power supply 61A or the second alternating electric current power supply 61B supplies an alternating electric current to the exciting coil 26, the exciting coil 26 generates a magnetic flux toward the first heat generation layer 21*a* depicted in FIG. 3A of the fixing belt 21 and the second heat generation layer 23*a* depicted in FIG. 3B of the heat generator 23. The exciting coil core 27, made of ferromagnet (e.g., ferrite) having a relative permeability of about 2,500, directs the magnetic flux generated by the exciting coil 26 to the first heat generation layer 21*a* of the fixing belt 21 and the second heat generation layer 23*a* of the heat generator 23 efficiently. As shown in FIG. 2, the exciting circuit 60 includes the exciting coil unit 25 and the two alternating electric current power supplies, that is, the first alternating electric current power supply 61A and the second alternating electric current power supply 61B that change the frequency or the wavelength of an alternating electric current passing through the exciting coil unit 25. A description of the exciting circuit 60 is deferred.

As illustrated in FIG. 2, the shield 24, disposed opposite the exciting coil unit 25 via the heat generator 23 and the fixing belt 21, is a plate made of a non-magnetic metal material such as aluminum and/or copper which shields the magnetic flux generated by the exciting coil unit 25. Thus, even when the magnetic flux generated by the exciting coil unit 25 penetrates the fixing belt 21 and the heat generator 23, the shield 24 generates an eddy current that offsets the penetrating magnetic flux, reducing leakage of the magnetic flux from the fixing belt 21 and the heat generator 23 for improved heating efficiency for heating the fixing belt 21.

As illustrated in FIG. 2, the pressing roller 31 serves as a pressing rotary body that presses against the outer circumferential surface of the fixing belt 21 at the fixing nip N. The pressing roller 31 is constructed of a hollow metal core 32 and an elastic layer 33 disposed on the metal core 32. The elastic layer 33, having a thickness of about 3 mm, is made of silicone rubber foam, silicone rubber, and/or fluorocarbon rubber. Optionally, a thin surface release layer made of PFA and/or PTFE may be disposed on the elastic layer 33. The pressing roller 31 is pressed against the nip formation pad 22 via the fixing belt 21 to form the desired fixing nip N between the pressing roller 31 and the fixing belt 21.

On the pressing roller 31 is mounted a gear engaging a driving gear of a driving mechanism that drives and rotates the pressing roller 31 counterclockwise in FIG. 2 in a rotation direction R2 counter to the rotation direction R1 of the fixing belt 21. Lateral ends of the pressing roller 31 in a longitudinal direction, that is, an axial direction thereof, are rotatably supported by the side plates of the fixing device 20 via bearings, respectively. Optionally, a heat source, such as a halogen heater, may be disposed inside the pressing roller 31.

With the elastic layer 33 of the pressing roller 31 made of a sponge material such as silicone rubber foam, the pressing roller 31 applies decreased pressure to the nip formation pad 22 via the fixing belt 21 at the fixing nip N to decrease bending of the nip formation pad 22. Further, the pressing roller 31 provides increased heat insulation that minimizes heat conduction thereto from the fixing belt 21, improving heating efficiency of the fixing belt 21.

As a mechanism to convey the recording medium P bearing the toner image T to and from the fixing nip N formed between the fixing belt 21 and the pressing roller 31, the fixing device 20 includes two guide plates, the guide 35 disposed at an entry to the fixing nip N and the guide 37 disposed at an exit of the fixing nip N. The guide 35 is directed to the entry to the fixing nip N to guide the recording medium P conveyed in a direction Y10 from the transfer device 7 depicted in FIG. 1 to the fixing nip N. The guide 37 is directed to a conveyance path downstream from the fixing device 20 in the conveyance direction of the recording medium P to guide the recording medium P discharged from the fixing nip N in the direction Y11 to the conveyance path. Both the guides 35 and 37 are mounted on a frame (e.g., a body) of the fixing device 20.

Referring to FIGS. 1 and 2, the following describes the operation of the fixing device 20 having the above-described structure.

When the image forming apparatus 1 is powered on, a high-frequency power supply, that is, the first alternating electric current power supply 61A, supplies an alternating electric current to the exciting coil 26 of the exciting coil unit 25, and at the same time the pressing roller 31 starts rotating in the rotation direction R2. Accordingly, the fixing belt 21 rotates in accordance with rotation of the pressing roller 31 in the rotation direction R1 counter to the rotation direction R2 of the pressing roller 31 due to friction therebetween at the fixing nip N.

Thereafter, at the transfer nip formed between the photoconductive drum 5 and the transfer device 7, the toner image T formed on the photoconductive drum 5 as described above is transferred onto a recording medium P sent from one of the paper trays 12 to 15. Being guided by the guide 35, the recording medium P bearing the toner image T is conveyed from the transfer nip in the direction Y 10 toward the fixing nip N, entering the fixing nip N formed between the fixing belt 21 and the pressing roller 31 pressed against each other.

As the recording medium P bearing the toner image T passes through the fixing nip N, it receives heat from the fixing belt 21 and pressure from the fixing belt 21, the nip formation pad 22, and the pressing roller 31 that form the fixing nip N. Thus, the toner image T is fixed on the recording medium P by the heat and the pressure applied at the fixing nip N. Thereafter, the recording medium P bearing the fixed toner image T is discharged from the fixing nip N and conveyed in the direction Y11 as guided by the guide 37.

Referring to FIGS. 2, 3A, 3B, 4A, and 4B, the following describes the configuration of the fixing device 20 according to the first illustrative embodiment of the present invention.

The fixing device 20 according to the first illustrative embodiment has a configuration that changes the frequency of an alternating electric current passing through the exciting coil 26 of the exciting coil unit 25. For example, as shown in FIGS. 2, 4A, and 4B, the exciting circuit 60 includes the two alternating electric current power supplies, that is, the first alternating electric current power supply 61A that outputs a first alternating electric current and the second alternating electric current power supply 61B that outputs a second alternating electric current having the frequency different from that of the first alternating electric current. Specifically, the first alternating electric current power supply 61A outputs the first alternating electric current having a relatively high frequency or a relatively short wavelength. By contrast, the second alternating electric current power supply 61B outputs the second alternating electric current having a relatively low frequency or a relatively long wavelength.

With this configuration of the first alternating electric current power supply 61A and the second alternating electric current power supply 61B, the exciting circuit 60 changes the frequency of an alternating electric current passing through the exciting coil 26 of the exciting coil unit 25, thus switching between a first heating state in which the exciting coil unit 25 heats only the first heat generation layer 21*a* of the fixing belt 21 by electromagnetic induction to heat the fixing belt 21 and a second heating state in which the exciting coil unit 25 heats both the first heat generation layer 21*a* of the fixing belt 21 and the second heat generation layer 23*a* of the heat generator 23 by electromagnetic induction to heat the fixing belt 21 directly and at the same time heat the fixing belt 21 indirectly via the heat generator 23. Specifically, a switch circuit 62 installed in the exciting circuit 60 switches the power supply connected to the exciting coil 26 of the exciting coil unit 25 between the first alternating electric current power supply 61A and the second alternating electric current power supply 61B, thus changing the frequency of the alternating electric current passing through the exciting coil 26 to switch between the first heating state and the second heating state.

For example, as shown in FIG. 4A, when the exciting coil 26 is connected to the first alternating electric current power supply 61A that outputs an alternating electric current of a higher frequency or a shorter wavelength, a magnetic flux generated by the exciting coil unit 25, which is indicated by the broken line, reaches the first heat generation layer 21*a* depicted in FIG. 3A of the fixing belt 21 only and does not reach the second heat generation layer 23*a* depicted in FIG. 3B of the heat generator 23. Accordingly, the exciting coil unit 25 heats only the first heat generation layer 21*a* of the fixing belt 21 by electromagnetic induction in the first heating state. Since the magnetic flux generated by the exciting coil unit 25 is concentrated on the first heat generation layer 21*a* only, the first heat generation layer 21*a* is heated quickly. It is to be noted that, although heat is conducted from the fixing belt 21 to the heat generator 23 in the first heating state, the heat generator 23 contacts a part of the inner circumferential surface of the fixing belt 21 in a circumferential direction of the fixing belt 21 at a limited area with a relatively small heat capacity, minimizing reduction of heating efficiency of the fixing belt 21.

By contrast, as shown in FIG. 4B, when the exciting coil 26 is connected to the second alternating electric current power supply 61B that outputs an alternating electric current of a lower frequency or a longer wavelength, a magnetic flux generated by the exciting coil unit 25, which is indicated by the broken line, penetrates the first heat generation layer 21*a* depicted in FIG. 3A of the fixing belt 21 and reaches the second heat generation layer 23*a* depicted in FIG. 3B of the heat generator 23. Thus, the exciting coil unit 25 heats the second heat generation layer 23*a* of the heat generator 23 as well as the first heat generation layer 21*a* of the fixing belt 21 by electromagnetic induction in the second heating state. Since the magnetic flux generated by the exciting coil unit 25 is diffused to the second heat generation layer 23*a* of the heat generator 23 also, the heat generator 23 heats the fixing belt 21 supplementarily to maintain the desired fixing temperature of the fixing belt 21.

As described above, the magnetic flux generated by the exciting coil unit 25 is applied to a region, that is, a skin depth, of the first heat generation layer 21*a* of the fixing belt 21 that varies depending on the frequency or the wavelength of the alternating electric current passing through the exciting coil unit 25. This is because the skin depth is proportional to the specific resistance of the first heat generation layer 21*a* and inversely proportional to the magnetic permeability of the first heat generation layer 21*a* and the frequency of the alternating electric current that excites the first heat generation layer 21*a*.

With the configuration described above for switching between the first heating state and the second heating state according to the condition of the fixing device 20 described below, the fixing belt 21 is heated in the appropriate heating state selected according to the temperature of the fixing belt 21, improving heating efficiency for heating the fixing belt 21 by electromagnetic induction and shortening the time required to heat the fixing belt 21 to the desired fixing temperature.

For example, according to the first illustrative embodiment, the controller 6 depicted in FIG. 2 controls switching of the power supply connected to the exciting coil unit 25 between the first alternating electric current power supply 61A and the second alternating electric current power supply 61B so that the fixing device 20 is in the first heating state when the fixing device 20 or the image forming apparatus 1 depicted in FIG. 1 is warmed up and in the second heating state when the plurality of recording media P bearing the toner image T is conveyed through the fixing nip N of the fixing device 20 continuously.

With such control, even when the fixing belt 21 is cool in the morning after the image forming apparatus 1 has been powered off for a long time, the fixing belt 21 is heated in the first heating state within a shortened warm-up time. Conversely, as the plurality of recording media P is conveyed through the fixing nip N formed between the fixing belt 21 and the pressing roller 31 continuously, they draw heat from the fixing belt 21, decreasing the temperature of the fixing belt 21 gradually. To address this problem, the exciting coil unit 25 heats the fixing belt 21 in the second heating state to conduct heat generated by the heat generator 23 to the fixing belt 21, thus heating the fixing belt 21 supplementarily to offset the temperature decrease of the fixing belt 21 and minimizing formation of a faulty toner image due to the decreased temperature of the fixing belt 21 caused by the recording media P conveyed through the fixing nip N continuously.

Referring to FIGS. 2, 3A, 4A, 4B, and 5, the following describes the material of the first heat generation layer 21*a* of the fixing belt 21.

The first heat generation layer 21*a* is made of a magnetic shunt metal material having ferromagnetism such as iron, nickel, cobalt, and/or an alloy of these, preferably a magnetic shunt metal material having property changing from ferromagnetism to paramagnetism such as iron, nickel, silicone, boron, niobium, copper, zirconium, cobalt, and/or an alloy of these.

With the first heat generation layer 21*a* made of the above-described material, when a Curie temperature of the first heat generation layer 21*a* is set to around a predetermined fixing temperature, the fixing belt 21 is not heated to above the fixing temperature. Accordingly, ripple in the temperature of the fixing belt 21 is decreased even when the plurality of recording media P is conveyed through the fixing nip N continuously, stabilizing fixing performance and gloss application to the fixed toner image T on the recording medium P.

Further, when a Curie temperature of the first heat generation layer 21*a* is set to not greater than an upper temperature limit of the fixing belt 21, non-conveyance regions NR on the fixing belt 21, provided at lateral ends thereof in the axial direction, through which the recording media P do not pass are not overheated to above the upper temperature limit of the fixing belt 21. Accordingly, even when small recording media P, which have a small width in the axial direction of the fixing belt 21 and therefore do not pass through the non-conveyance regions NR of the fixing belt 21, are conveyed through the fixing nip N continuously, the fixing belt 21 may not be overheated due to absence of the recording media P that draw heat from the non-conveyance regions NR on the fixing belt 21.

Figure 5:
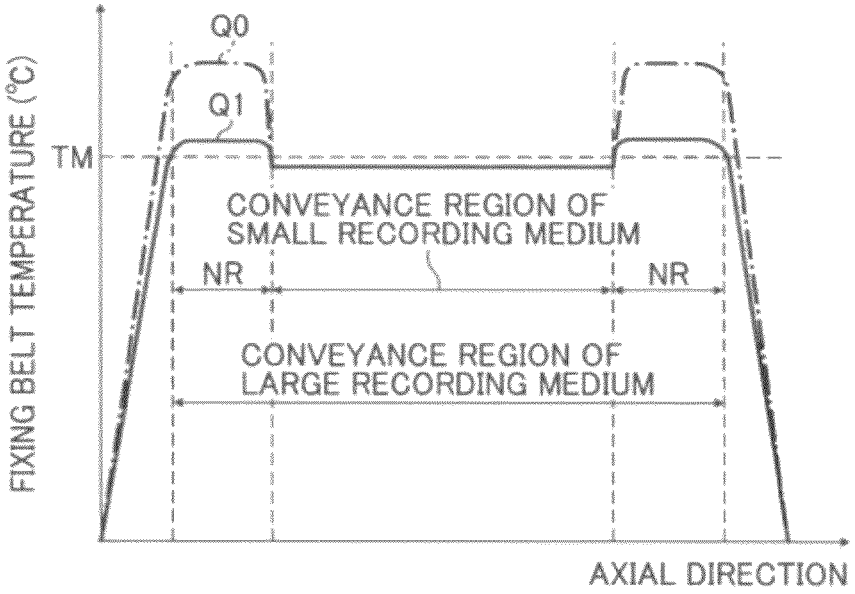
FIG. 5 is a graph illustrating a temperature distribution of the fixing belt shown in FIG. 3A in an axial direction thereof when small recording media are conveyed to a fixing nip of the fixing device shown in FIG. 2 continuously.

FIG. 5 is a graph illustrating a temperature distribution of the fixing belt 21 in the axial direction thereof when small recording media P are conveyed through the fixing nip N continuously. The graph shows the two lines: a line Q0, that is, the alternate-long-and-short-dashed line, indicating the temperature distribution of the fixing belt 21 with the first heat generation layer 21*a* made of general metal; and a line Q1, that is, the solid line, indicating the temperature distribution of the fixing belt 21 with the first heat generation layer 21*a* made of a magnetic shunt metal material. The line Q1 shows that, with the first heat generation layer 21*a* made of the magnetic shunt metal material, the temperature of the fixing belt 21 is suppressed to around a predetermined fixing temperature TM even in the non-conveyance regions NR thereon through which small recording media P do not pass.

Alternatively, the first heat generation layer 21*a* of the fixing belt 21 may be made of a non-magnetic metal material such as gold, silver, copper, aluminum, zinc, tin, lead, bismuth, beryllium, antimony, and/or an alloy of these.

With the first heat generation layer 21*a* made of the above-described alternative material, even when the distance between the exciting coil unit 25 and the fixing belt 21 disposed opposite each other changes, an amount of magnetic flux generated by the exciting coil unit 25 and penetrating the fixing belt 21 does not change substantially, minimizing variation in heating of the fixing belt 21 in the axial direction thereof. Moreover, even when the fixing belt 21 is displaced or skewed in the axial direction thereof as it rotates in the rotation direction R1, it can be heated substantially uniformly in the axial direction thereof.

Preferably, the first heat generation layer 21*a* of the fixing belt 21 has a thickness smaller than a skin depth when an alternating electric current of a predetermined frequency is applied to the exciting coil 26 of the exciting coil unit 25. The "skin depth" defines a value obtained based on the specific resistance and the magnetic permeability of the first heat generation layer 21*a* and the frequency of the alternating electric current that excites the first heat generation layer 21*a*. According to the first illustrative embodiment, the frequency of the first alternating electric current output from the first alternating electric current power supply 61A and the frequency of the second alternating electric current output from the second alternating electric current power supply 61B are in a range of from about 20 kHz to about 100 kHz although the frequency of the first alternating electric current is different from that of the second alternating electric current.

Thus, with the first heat generation layer 21*a* having the thickness smaller than the skin depth as described above according to the first illustrative embodiment, the magnetic flux generated by the exciting coil unit 25 precisely reaches the second heat generation layer 23*a* of the heat generator 23 in the second heating state shown in FIG. 4B.

Referring to FIGS. 2, 3B, 4A, and 4B, the following describes the material of the second heat generation layer 23*a* of the heat generator 23.

The second heat generation layer 23*a* is made of a magnetic shunt metal material having property changing from ferromagnetism to paramagnetism such as iron, nickel, silicone, boron, niobium, copper, zirconium, cobalt, and/or an alloy of these.

With the second heat generation layer 23*a* made of the above-described material, when a Curie temperature of the second heat generation layer 23*a* is set to a temperature higher than the predetermined fixing temperature and not higher than the upper temperature limit of the fixing belt 21, the fixing belt 21 is not overheated. When the temperature of the second heat generation layer 23*a* exceeds the Curie temperature, the magnetic flux generated by the exciting coil unit 25 penetrates the second heat generation layer 23*a* and reaches the shield 24 made of a non-magnetic material; the shield 24 generates an eddy current that offsets the penetrating magnetic flux.

Alternatively, the second heat generation layer 23*a* of the heat generator 23 may be made of a ferromagnetic metal material such as iron, nickel, and/or cobalt.

With the second heat generation layer 23*a* made of the above-described material, even in the second heating state shown in FIG. 4B, the magnetic flux generated by the exciting coil unit 25 does not penetrate the second heat generation layer 23*a* of the heat generator 23, thus improving heating efficiency for heating the heat generator 23 by electromagnetic induction even without the shield 24.

According to the first illustrative embodiment described above, the heat generator 23 is constructed of the single layer, that is, the second heat generation layer 23*a*. Alternatively, the heat generator 23 may be constructed of multiple layers: an inner surface layer serving as a heat generation layer, which generates heat by electromagnetic induction, equivalent to the second heat generation layer 23*a*; an intermediate layer made of a high-thermal conductive material such as aluminum, iron, and/or stainless steel; and an outer surface layer serving as another heat generation layer, which generates heat by electromagnetic induction, equivalent to the second heat generation layer 23*a*, for example.

Figure 6A:
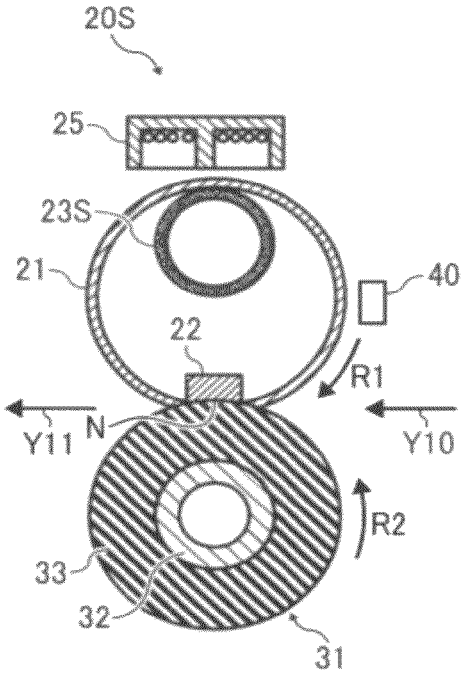
FIG. 6A is a vertical sectional view of a fixing device as a first variation of the fixing device shown in FIG. 2.
Figure 6B:
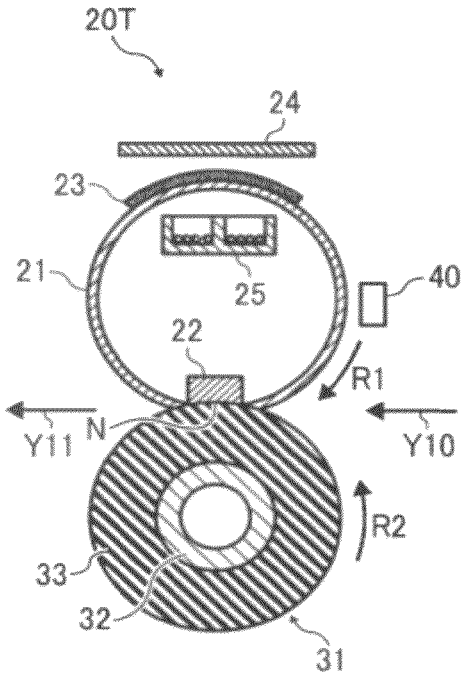
FIG. 6B is a vertical sectional view of a fixing device as a second variation of the fixing device shown in FIG. 2.

Referring to FIGS. 6A and 6B, the following describes variations of the fixing device 20 according to the first illustrative embodiment. FIG. 6A is a vertical sectional view of a fixing device 20S that employs a tubular heat generator 23S instead of the arc-shaped heat generator 23 depicted in FIG. 2 as a first variation of the fixing device 20. FIG. 6B is a vertical sectional view of a fixing device 20T that employs the heat generator 23, the shield 24, and the exciting coil unit 25 disposed at positions different from those of the fixing device 20 depicted in FIG. 2 as a second variation of the fixing device 20.

According to the first illustrative embodiment described above, the fixing device 20 employs the substantially semi-cylindrical heat generator 23 as shown in FIG. 2. Alternatively, the heat generator may be cylindrical as shown in FIG. 6A. As illustrated in FIG. 6A, the cylindrical heat generator 23S contacts the inner circumferential surface of the fixing belt 21.

Further, the heat generator may be disposed outside the loop formed by the fixing belt 21 as shown in FIG. 6B. Specifically, as illustrated in FIG. 2, the fixing device 20 according to the first illustrative embodiment employs the heat generator 23 that contacts the inner circumferential surface of the fixing belt 21 and the exciting coil unit 25 that faces the outer circumferential surface of the fixing belt 21. Alternatively, as illustrated in FIG. 6B, the heat generator 23 may contact the outer circumferential surface of the fixing belt 21; the exciting coil unit 25 may face the inner circumferential surface of the fixing belt 21; and the shield 24 may be disposed outside the loop formed by the fixing belt 21 in such a manner that the heat generator 23 is disposed between the shield 24 and the fixing belt 21.

The configurations of the fixing devices 20S and 20T also switch between the first heating state and the second heating state by changing the frequency of the alternating electric current passing through the exciting coil unit 25, thus attaining the advantages of the configuration of the fixing device 20 shown in FIG. 2.

As described above, the fixing devices 20, 20S, and 20T according to the first illustrative embodiment switch between the first heating state and the second heating state by changing the frequency of the alternating electric current passing through the exciting coil unit 25: the first heating state in which the magnetic flux generated by the exciting coil unit 25 heats only the first heat generation layer 21*a* of the fixing belt 21 by electromagnetic induction, thus heating the fixing belt 21; the second heating state in which the magnetic flux generated by the exciting coil unit 25 heats both the first heat generation layer 21*a* of the fixing belt 21 and the second heat generation layer 23*a* of the heat generator 23 by electromagnetic induction, thus heating the fixing belt 21 directly and at the same time heating the fixing belt 21 indirectly via the heat generator 23. That is, the fixing belt 21 is heated efficiently within a shortened period of time.

Figure 7:
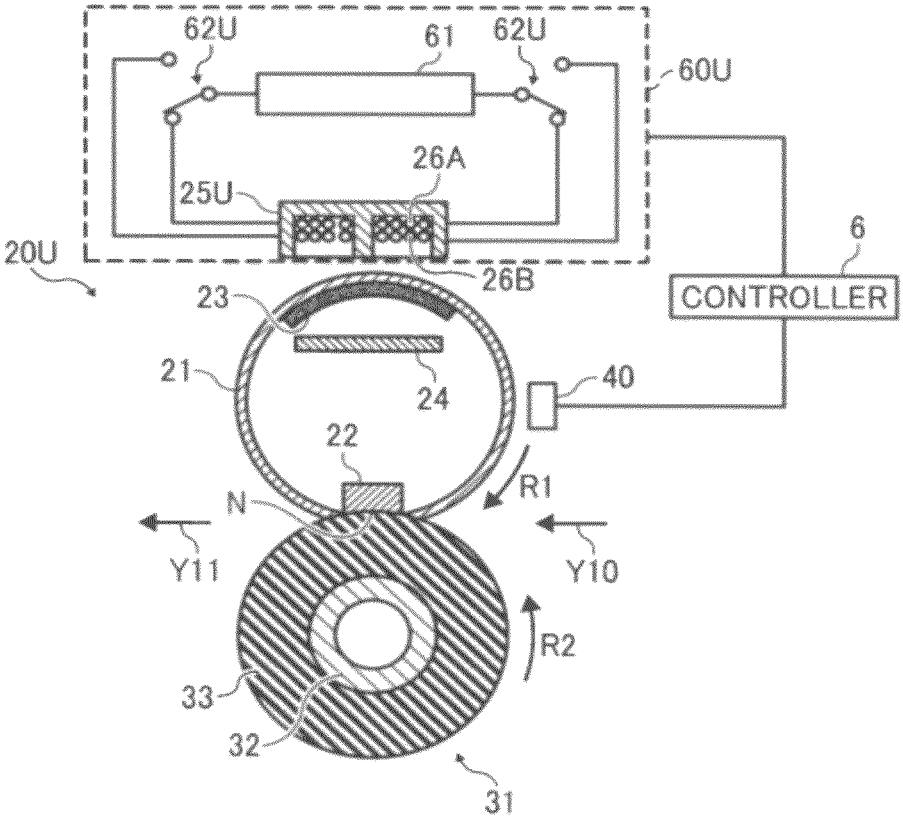
FIG. 7 is a vertical sectional view of a fixing device according to a second exemplary embodiment of the present invention.
Figure 8A:
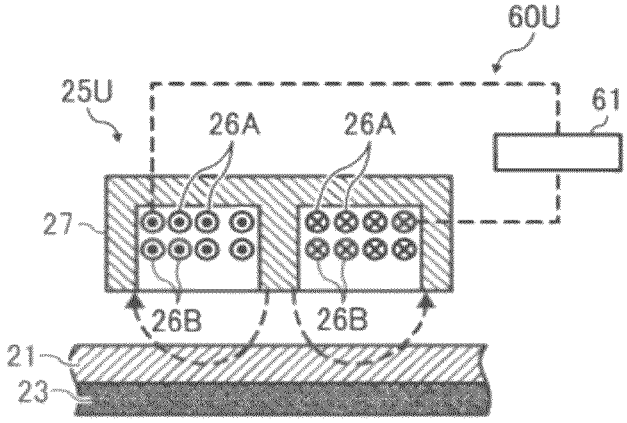
FIG. 8A is a partially enlarged vertical sectional view of a heat generator, a fixing belt, an exciting coil unit, and an alternating electric current power supply installed in the fixing device shown in FIG. 7 in a first heating state.
Figure 8B:
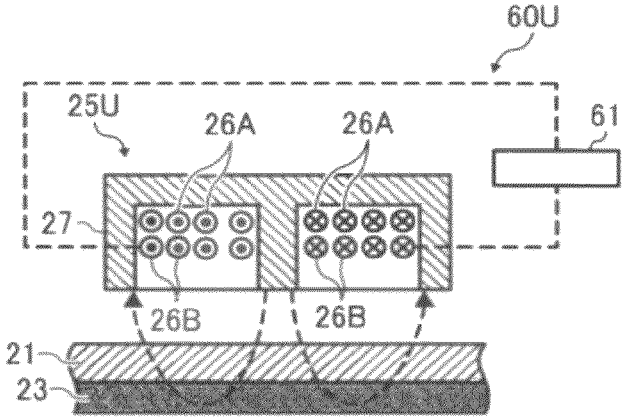
FIG. 8B is a partially enlarged vertical sectional view of a heat generator, a fixing belt, an exciting coil unit, and an alternating electric current power supply installed in the fixing device shown in FIG. 7 in a second heating state.

Referring to FIGS. 7, 8A, and 8B, the following describes a fixing device 20U according to a second illustrative embodiment of the present invention.

FIG. 7 is a vertical sectional view of the fixing device 20U. FIG. 8A is a partially enlarged vertical sectional view of the heat generator 23, the fixing belt 21, an exciting coil unit 25U, and an alternating electric current power supply 61 of the fixing device 20U in a first heating state. FIG. 8B is a partially enlarged vertical sectional view of the heat generator 23, the fixing belt 21, the exciting coil unit 25U, and the alternating electric current power supply 61 of the fixing device 20U in a second heating state.

Unlike the fixing device 20 shown in FIG. 2 according to the first illustrative embodiment that includes the exciting circuit 60 having a plurality of alternating electric current power supplies, that is, the first alternating electric current power supply 61A and the second alternating electric current power supply 61B, the fixing device 20U according to the second illustrative embodiment includes an exciting circuit 60U having a plurality of exciting coils having different inductances, respectively, that is, a first exciting coil 26A and a second exciting coil 26B disposed in the exciting coil unit 25U. In the first heating state shown in FIG. 8A, the first exciting coil 26A is connected to the alternating electric current power supply 61. In the second heating state shown in FIG. 8B, the second exciting coil 26B is connected to the alternating electric current power supply 61.

As illustrated in FIG. 7, like the fixing device 20 shown in FIG. 2, the fixing device 20U further includes the fixing belt 21 formed into a loop, serving as a fixing rotary body that rotates in the rotation direction R1; the nip formation pad 22, the heat generator 23, and the shield 24, which are disposed inside the loop formed by the fixing belt 21; the pressing roller 31 serving as a pressing rotary body that rotates in the rotation direction R2 counter to the rotation direction R1 of the fixing belt 21; and the temperature sensor 40 serving as a temperature detector that detects the temperature of the fixing belt 21. The pressing roller 31 and the temperature sensor 40 are disposed outside the loop formed by the fixing belt 21.

However, unlike the fixing device 20 shown in FIG. 2, the fixing device 20U has the exciting circuit 60U provided with the single alternating electric current power supply 61 (e.g., a high-frequency power supply). Further, the exciting coil unit 25U of the fixing device 20U has the two exciting coils having different inductances, respectively, that is, the first exciting coil 26A and the second exciting coil 26B placed side by side with the first exciting coil 26A. Specifically, the first exciting coil 26A has a relatively small inductance; the second exciting coil 26B has a relatively great inductance.

Similar to the fixing devices 20, 20S, and 20T according to the first illustrative embodiment, the fixing device 20U according to the second illustrative embodiment switches between the first heating state and the second heating state by changing the frequency of the alternating electric current passing through the first exciting coil 26A and the second exciting coil 26B of the exciting coil unit 25U: the first heating state in which a magnetic flux generated by the exciting coil unit 25U heats only the first heat generation layer 21*a* of the fixing belt 21 by electromagnetic induction, thus heating the fixing belt 21; the second heating state in which a magnetic flux generated by the exciting coil unit 25U heats both the first heat generation layer 21*a* of the fixing belt 21 and the second heat generation layer 23*a* of the heat generator 23 by electromagnetic induction, thus heating the fixing belt 21 directly and at the same time heating the fixing belt 21 indirectly via the heat generator 23. For example, a switch circuit 62U installed in the exciting circuit 60U switches the exciting coil connected to the alternating electric current power supply 61 between the first exciting coil 26A and the second exciting coil 26B, thus changing the frequency of the alternating electric current passing through the exciting coil unit 25U to switch between the first heating state and the second heating state.

For example, as shown in FIG. 8A, when the first exciting coil 26A having a relatively low inductance is connected to the alternating electric current power supply 61, an alternating electric current of a higher frequency passes through the exciting coil unit 25U. Accordingly, a magnetic flux generated by the exciting coil unit 25U, which is indicated by the broken line, reaches the first heat generation layer 21*a* depicted in FIG. 3A of the fixing belt 21 only and does not reach the second heat generation layer 23*a* depicted in FIG. 3B of the heat generator 23. Consequently, the exciting coil unit 25U heats only the first heat generation layer 21*a* of the fixing belt 21 by electromagnetic induction in the first heating state.

By contrast, as shown in FIG. 8B, when the second exciting coil 26B having a relatively high inductance is connected to the alternating electric current power supply 61, an alternating electric current of a lower frequency passes through the exciting coil unit 25U. Accordingly, a magnetic flux generated by the exciting coil unit 25U, which is indicated by the broken line, penetrates the first heat generation layer 21*a* of the fixing belt 21 and reaches the second heat generation layer 23*a* of the heat generator 23. Thus, the exciting coil unit 25U heats the second heat generation layer 23*a* of the heat generator 23 as well as the first heat generation layer 21*a* of the fixing belt 21 by electromagnetic induction in the second heating state.

Also with the fixing device 20U according to the second illustrative embodiment, the controller 6 depicted in FIG. 7 controls switching of the exciting coil connected to the alternating electric current power supply 61 between the first exciting coil 26A and the second exciting coil 26B. For example, the exciting coil unit 25U heats the fixing belt 21 in the first heating state when the fixing device 20 or the image forming apparatus 1 depicted in FIG. 1 is warmed up. Conversely, the exciting coil unit 25U heats the fixing belt 21 in the second heating state when recording media P are conveyed through the fixing nip N continuously, attaining advantages similar to those of the first illustrative embodiment.

As described above, like the fixing devices 20, 20S, and 20T according to the first illustrative embodiment, the fixing device 20U according to the second illustrative embodiment switches between the first heating state and the second heating state by changing the frequency of the alternating electric current passing through the exciting coil unit 25U: the first heating state in which the magnetic flux generated by the exciting coil unit 25U heats only the first heat generation layer 21*a* of the fixing belt 21 by electromagnetic induction, thus heating the fixing belt 21; the second heating state in which the magnetic flux generated by the exciting coil unit 25U heats both the first heat generation layer 21*a* of the fixing belt 21 and the second heat generation layer 23*a* of the heat generator 23 by electromagnetic induction, thus heating the fixing belt 21 directly and at the same time heating the fixing belt 21 indirectly via the heat generator 23. That is, the fixing belt 21 is heated efficiently within a shortened period of time.

Figure 9:
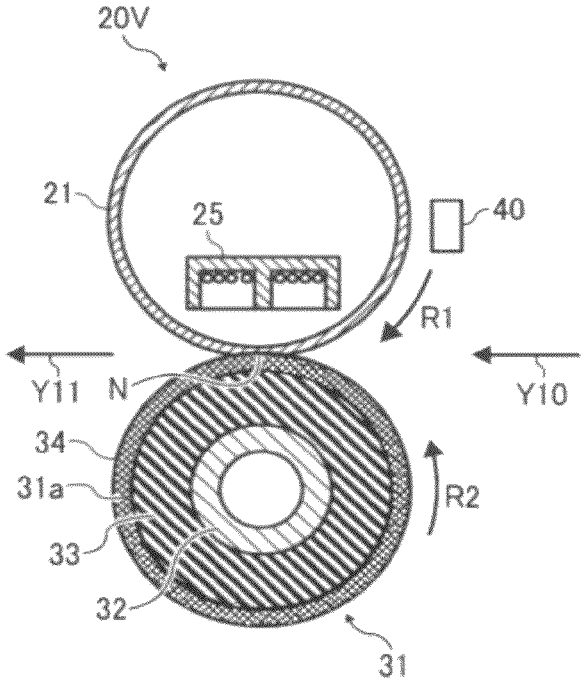
FIG. 9 is a vertical sectional view of a fixing device according to a third exemplary embodiment of the present invention.

Referring to FIG. 9, the following describes a fixing device 20V according to a third illustrative embodiment of the present invention.

FIG. 9 is a vertical sectional view of the fixing device 20V. The fixing device 20V is different from the fixing devices 20, 20S, and 20U depicted in FIGS. 2, 6A, and 7 in that the heat generator is not disposed inside the fixing belt 21.

As illustrated in FIG. 9, the fixing device 20V includes the fixing belt 21, formed into a loop, serving as a fixing rotary body that rotates in the rotation direction R1; the exciting coil unit 25 disposed inside the loop formed by the fixing belt 21; the pressing roller 31, constructed of the metal core 32, the elastic layer 33, a second heat generation layer 31*a*, and a release layer 34 (e.g., a PFA tube), serving as a pressing rotary body that rotates in the rotation direction R2 counter to the rotation direction R1 of the fixing belt 21; and the temperature sensor 40 serving as a temperature detector that detects the temperature of the fixing belt 21. The pressing roller 31 and the temperature sensor 40 are disposed outside the loop formed by the fixing belt 21.

Since the fixing device 20V does not have the heat generator 23 depicted in FIG. 2, the pressing roller 31 includes the second heat generation layer 31*a* that generates heat by electromagnetic induction. Similar to the second heat generation layer 23*a* of the heat generator 23 depicted in FIG. 3B, the second heat generation layer 31*a* of the pressing roller 31 is also made of a conductive material; thus, the pressing roller 31 also serves as a heat generator that generates heat by a magnetic flux generated by the exciting coil unit 25 disposed opposite the pressing roller 31 via the fixing belt 21.

With this configuration of the fixing device 20V, similar to the fixing devices 20, 20S, 20T, and 20U depicted in FIGS. 2, 6A, 6B, and 7, respectively, the frequency of the alternating electric current passing through the exciting coil unit 25 is changed, thus switching between the first heating state in which the exciting coil unit 25 heats only the first heat generation layer 21*a* depicted in FIG. 3A of the fixing belt 21 and the second heating state in which the exciting coil unit 25 heats both the first heat generation layer 21*a* of the fixing belt 21 and the second heat generation layer 31*a* of the pressing roller 31.

Figure 10:
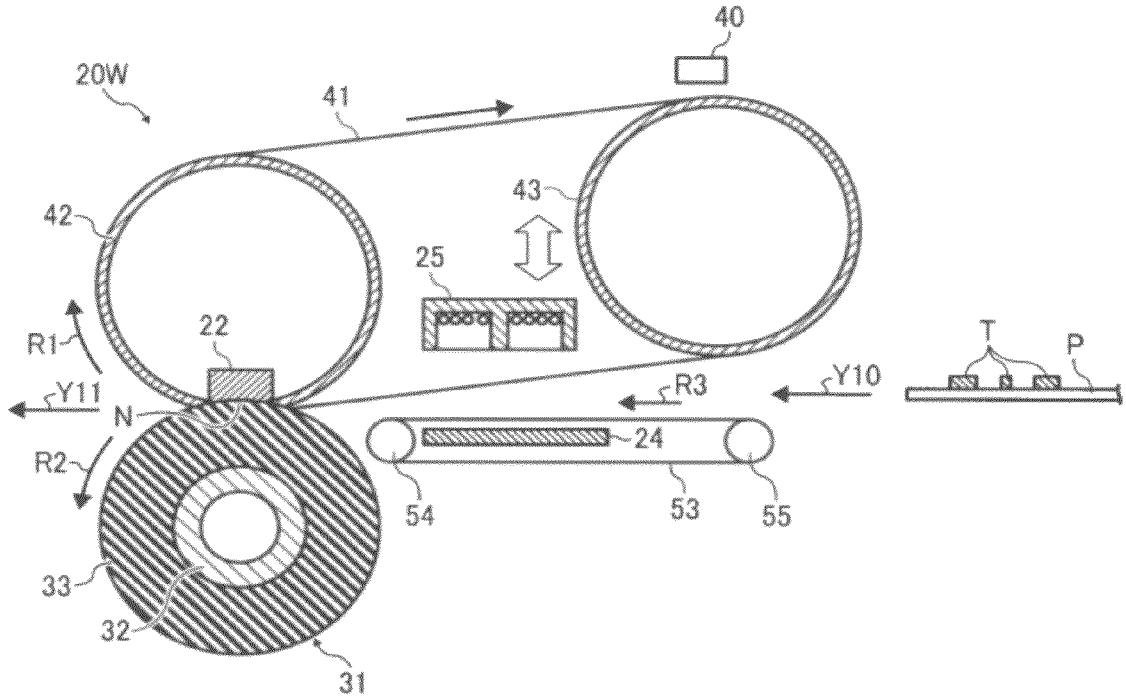
FIG. 10 is a vertical sectional view of a fixing device according to a fourth exemplary embodiment of the present invention.
Figure 11A:
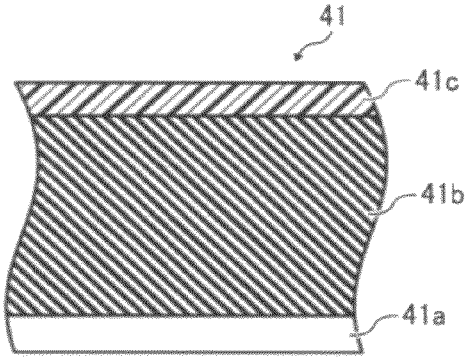
FIG. 11A is a partial vertical sectional view of a fixing belt installed in the fixing device shown in FIG. 10.
Figure 11B:
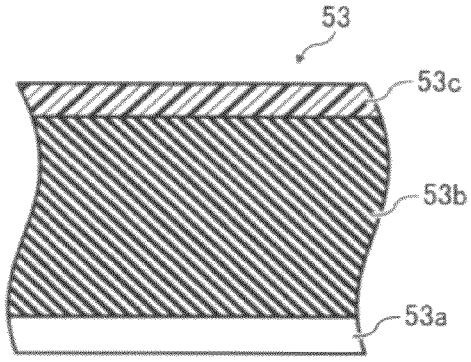
FIG. 11B is a partial vertical sectional view of a conveyance belt installed in the fixing device shown in FIG. 10.

Referring to FIGS. 10, 11A, and 11B, the following describes a fixing device 20W according to a fourth illustrative embodiment of the present invention. FIG. 10 is a vertical sectional view of the fixing device 20W. FIG. 11A is a partial vertical sectional view of a fixing belt 41 installed in the fixing device 20W. FIG. 11B is a partial vertical sectional view of a conveyance belt 53 installed in the fixing device 20W.

As illustrated in FIG. 10, the fixing device 20W includes the fixing belt 41, formed into an elliptic loop, serving as a fixing rotary body that rotates in the rotation direction R1; a fixing roller 42, a support roller 43, and the exciting coil unit 25, which are disposed inside the elliptic loop formed by the fixing belt 41; the nip formation pad 22 disposed inside the fixing roller 42; the pressing roller 31, constructed of the metal core 32 and the elastic layer 33, serving as a pressing rotary body that rotates in the rotation direction R2 counter to the rotation direction R1 of the fixing belt 41; the temperature sensor 40 serving as a temperature detector that detects the temperature of the fixing belt 41; a conveyance belt 53, formed into an elliptic loop, which conveys a recording medium P bearing a toner image T toward the fixing nip N formed between the nip formation pad 22 and the pressing roller 31 via the fixing roller 42 and the fixing belt 41; two rollers 54 and 55 that stretch and support the conveyance belt 53; and the shield 24 disposed inside the elliptic loop formed by the conveyance belt 53.

Specifically, the fixing belt 41 is stretched over and supported by the fixing roller 42 and the support roller 43. The pressing roller 31 presses against the nip formation pad 22 via the fixing belt 41 and the fixing roller 42 to form the fixing nip N between the pressing roller 31 and the fixing belt 41. The conveyance belt 53 is stretched over and supported by the two rollers 54 and 55; the roller 54 drives and rotates the conveyance belt 53 in a rotation direction R3 to feed the recording medium P conveyed in the direction Y 10 toward the fixing nip N.

Similar to the fixing belt 21 depicted in FIG. 3A, as illustrated in FIG. 11A, the fixing belt 41 is constructed of multiple layers: a first heat generation layer 41*a* that generates heat by a magnetic flux generated by the exciting coil unit 25 by electromagnetic induction; an elastic layer 41*b* disposed on the first heat generation layer 41*a*; and a release layer 41*c* disposed on the elastic layer 41*b* as an outer layer contacting the recording medium P.

Since the fixing device 20W does not have the heat generator 23 depicted in FIG. 2, the conveyance belt 53 includes a second heat generation layer 53*a* that generates heat by electromagnetic induction as shown in FIG. 11B. Like the fixing belt 21 shown in FIG. 3A, the conveyance belt 53 is constructed of multiple layers: the second heat generation layer 53*a* that generates heat by a magnetic flux generated by the exciting coil unit 25 by electromagnetic induction; an elastic layer 53*b* disposed on the second heat generation layer 53*a*; and a release layer 53*c* disposed on the elastic layer 53*b* as an outer layer contacting the recording medium P.

Similar to the second heat generation layer 23*a* of the heat generator 23 depicted in FIG. 3B, the second heat generation layer 53*a* of the conveyance belt 53 is also made of a conductive material; thus, the conveyance belt 53 serves as a heat generator that generates heat by a magnetic flux generated by the exciting coil unit 25 disposed opposite the conveyance belt 53 via the fixing belt 41.

With this configuration of the fixing device 20W, similar to the fixing devices 20, 20S, 20T, 20U, and 20V depicted in FIGS. 2, 6A, 6B, 7, and 9, respectively, the frequency of the alternating electric current passing through the exciting coil unit 25 is changed, thus switching between the first heating state in which the exciting coil unit 25 heats only the first heat generation layer 41*a* of the fixing belt 41 and the second heating state in which the exciting coil unit 25 heats both the first heat generation layer 41*a* of the fixing belt 41 and the second heat generation layer 53*a* of the conveyance belt 53.

As a mechanism that changes the frequency of the alternating electric current passing through the exciting coil unit 25, the fixing devices 20V and 20W may employ the exciting circuit 60 including the first alternating electric current power supply 61A and the second alternating electric current power supply 61B shown in FIG. 2 or the exciting circuit 60U including the first exciting coil 26A and the second exciting coil 26B shown in FIG. 7.

With the configurations of the fixing devices 20V and 20W described above that change the frequency of the alternating electric current passing through the exciting coil unit 25, it is possible to switch between the first heating state and the second heating state: the first heating state that heats the fixing belts 21 and 41 by heating only the first heat generation layers 21*a* and 41*a* by electromagnetic induction; the second heating state that heats the fixing belts 21 and 41 directly and at the same time heats the fixing belts 21 and 41 indirectly via the pressing roller 31 and the conveyance belt 53 by heating both the first heat generation layers 21*a* and 41*a* and the second heat generation layers 31*a* and 53*a* by electromagnetic induction. Consequently, the fixing belts 21 and 41 are heated to the desired fixing temperature by electromagnetic induction with improved heating efficiency within a shortened period of time.

According to the above-described exemplary embodiments, the fixing belts 21 and 41 are used as a fixing rotary body that rotates in the predetermined direction of rotation; the pressing roller 31 is used as a pressing rotary body disposed opposite the fixing rotary body to form the fixing nip N therebetween and rotating in the direction counter to the direction of rotation of the fixing rotary body. Alternatively, a fixing film, a fixing roller, or the like may be used as a fixing rotary body; a pressing belt or the like may be used as a pressing rotary body, attaining advantages equivalent to those of the fixing devices according to the above-described exemplary embodiments.

Further, according to the above-described exemplary embodiments, each of the fixing devices 20, 20S, 20T, 20U, 20V, and 20W depicted in FIGS. 2, 6A, 6B, 7, 9, and 10, respectively, is installed in the monochrome image forming apparatus 1 (depicted in FIG. 1) for forming a monochrome toner image. Alternatively, each of the fixing devices 20, 20S, 20T, 20U, 20V, and 20W may be installed in a color image forming apparatus for forming a color toner image.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body including a first heat generation layer;

a pressing rotary body disposed parallel to and pressed against the fixing rotary body to form a fixing nip therebetween through which a recording medium bearing a toner image is conveyed;

a heat generator to heat the fixing rotary body, disposed opposite the fixing rotary body and including a second heat generation layer;

an exciting coil to generate a magnetic flux, disposed opposite the heat generator via the fixing rotary body;

a first alternating electric current power supply connectable to the exciting coil to output a first alternating electric current having a first frequency that causes the magnetic flux generated by the exciting coil to reach the first heat generation layer of the fixing rotary body;

a second alternating electric current power supply connectable to the exciting coil to output a second alternating electric current having a second frequency that is lower than the first frequency and causes the magnetic flux generated by the exciting coil to reach the first heat generation layer of the fixing rotary body and the second heat generation layer of the heat generator; and a switch circuit connected to the exciting coil, the first alternating electric current power supply, and the second alternating electric current power supply to selectively connect the first alternating electric current power supply or the second alternating electric current power supply to the exciting coil.

2. The fixing device according to claim 1, wherein the switch circuit connects the first alternating electric current power supply to the exciting coil when the fixing device is warmed up.

3. The fixing device according to claim 1, wherein the switch circuit connects the second alternating electric current power supply to the exciting coil when a plurality of recording media is conveyed through the fixing nip continuously.

4. The fixing device according to claim 1, wherein the fixing rotary body includes a fixing belt.

5. The fixing device according to claim 1, wherein the pressing rotary body includes a pressing roller.

6. The fixing device according to claim 1, wherein the first heat generation layer of the fixing rotary body is made of a magnetic shunt metal material.

7. The fixing device according to claim 1, wherein the first heat generation layer of the fixing rotary body is made of a non-magnetic metal material.

8. The fixing device according to claim 1, wherein the first heat generation layer of the fixing rotary body has a thickness smaller than a skin depth when the first alternating electric current of the first frequency is applied to the exciting coil, where the skin depth defines a value obtained based on a specific resistance and a magnetic permeability of the first heat generation layer of the fixing rotary body and the first frequency of the first alternating electric current that excites the first heat generation layer.

9. The fixing device according to claim 1, wherein the second heat generation layer of the heat generator is made of a magnetic shunt metal material.

10. The fixing device according to claim 1, wherein the second heat generation layer of the heat generator is made of a ferromagnetic metal material.

11. A fixing device comprising:

a fixing rotary body including a first heat generation layer;

a pressing rotary body disposed parallel to and pressed against the fixing rotary body to form a fixing nip therebetween through which a recording medium bearing a toner image is conveyed;

a heat generator to heat the fixing rotary body, disposed opposite the fixing rotary body and including a second heat generation layer;

a first exciting coil having a first inductance and disposed opposite the heat generator via the fixing rotary body to generate a magnetic flux;

a second exciting coil having a second inductance greater than the first inductance and disposed opposite the heat generator via the fixing rotary body to generate a magnetic flux;

an alternating electric current power supply connectable to the first exciting coil to output a first alternating electric current having a first frequency that causes the magnetic flux generated by the first exciting coil to reach the first heat generation layer of the fixing rotary body and connectable to the second exciting coil to output a second alternating electric current having a second frequency that is lower than the first frequency and causes the magnetic flux generated by the second exciting coil to reach the first heat generation layer of the fixing rotary body and the second heat generation layer of the heat generator; and a switch circuit connected to the first exciting coil, the second exciting coil, and the alternating electric current power supply to selectively connect the alternating electric current power supply to the first exciting coil or the second exciting coil.

12. The fixing device according to claim 11, wherein the switch circuit connects the alternating electric current power supply to the first exciting coil when the fixing device is warmed up.

13. The fixing device according to claim 11, wherein the switch circuit connects the alternating electric current power supply to the second exciting coil when a plurality of recording media is conveyed through the fixing nip continuously.

14. The fixing device according to claim 11, wherein the first heat generation layer of the fixing rotary body is made of a magnetic shunt metal material.

15. The fixing device according to claim 11, wherein the first heat generation layer of the fixing rotary body is made of a non-magnetic metal material.

16. The fixing device according to claim 11, wherein the first heat generation layer of the fixing rotary body has a thickness smaller than a skin depth when the first alternating electric current of the first frequency is applied to the first exciting coil, where the skin depth defines a value obtained based on a specific resistance and a magnetic permeability of the first heat generation layer of the fixing rotary body and the first frequency of the first alternating electric current that excites the first heat generation layer.

17. The fixing device according to claim 11, wherein the second heat generation layer of the heat generator is made of a magnetic shunt metal material.

18. The fixing device according to claim 11, wherein the second heat generation layer of the heat generator is made of a ferromagnetic metal material.

19. A fixing device comprising:

a fixing rotary body including a first heat generation layer;

a pressing rotary body disposed parallel to and pressed against the fixing rotary body to form a fixing nip therebetween through which a recording medium bearing a toner image is conveyed, the pressing rotary body including a second heat generation layer;

an exciting coil to generate a magnetic flux, disposed opposite the pressing rotary body via the fixing rotary body;

a first alternating electric current power supply connectable to the exciting coil to output a first alternating electric current having a first frequency that causes the magnetic flux generated by the exciting coil to reach the first heat generation layer of the fixing rotary body;

a second alternating electric current power supply connectable to the exciting coil to output a second alternating electric current having a second frequency that is lower than the first frequency and causes the magnetic flux generated by the exciting coil to reach the first heat generation layer of the fixing rotary body and the second heat generation layer of the pressing rotary body; and a switch circuit connected to the exciting coil, the first alternating electric current power supply, and the second alternating electric current power supply to selectively connect the first alternating electric current power supply or the second alternating electric current power supply to the exciting coil.

20. An image forming apparatus comprising the fixing device according to claim 1.

* * * * *